US006144822A

United States Patent [19]

Yamaguchi et al.

[11] Patent Number: 6,144,822

[45] Date of Patent: Nov. 7, 2000

[54] IMAGE FORMING APPARATUS HAVING DETACHABLE TRANSFER ROLLER AND DISCHARGE DEVICE

[75] Inventors: Toshitaka Yamaguchi, Ohmiya; Masaru Tanaka, Yokohama; Hiroshi Mizusawa, Ohta-ku; Kenzo Tatsumi, Yokohama; Ken Amemiya, Nerima-ku; Haruji Mizuishi, Ohta-ku; Hideki Zemba, Yokohama; Noriyuki Usui; Mayumi Ohori, both of Kawasaki, all of Japan

[73] Assignee: Ricoh Company, Ltd., Tokyo, Japan

[21] Appl. No.: 09/409,423

[22] Filed: Sep. 30, 1999

[30] Foreign Application Priority Data

Oct. 13, 1998 [JP] Japan ..... 10-290771

[51] Int. Cl.[7] ..... G03G 15/08

[52] U.S. Cl. ..... 399/121

[58] Field of Search ..... 399/121, 315, 399/107, 110, 115, 313

[56] References Cited

U.S. PATENT DOCUMENTS

| | | | |
|---|---|---|---|
| 5,345,295 | 9/1994 | Takano et al. . | |
| 5,633,703 | 5/1997 | Takenouchi et al. | 399/315 |
| 5,758,247 | 5/1998 | Yanashima et al. | 399/384 |
| 5,812,919 | 9/1998 | Takano et al. . | |
| 5,822,667 | 10/1998 | Hayama et al. . | |
| 5,857,132 | 1/1999 | Mizuishi et al. . | |
| 5,923,935 | 7/1999 | Yamaguchi . | |

FOREIGN PATENT DOCUMENTS

| | | |
|---|---|---|
| 6-003978 | 1/1994 | Japan . |
| 6-064279 | 3/1994 | Japan . |
| 7-168510 | 7/1995 | Japan . |
| 7-319298 | 12/1995 | Japan . |
| 8-200170 | 8/1996 | Japan . |
| 9-138590 | 5/1997 | Japan . |
| 9-236990 | 9/1997 | Japan . |
| 10-142950 | 5/1998 | Japan . |
| 10-247046 | 9/1998 | Japan . |

*Primary Examiner*—Robert Beatty
*Attorney, Agent, or Firm*—Oblon, Spivak, McClelland, Maier & Neustadt, P.C.

[57] ABSTRACT

An image forming apparatus is provided, which includes an image bearing member, a transfer roller having a shaft for transferring an image on the image bearing member to a transfer sheet, a bearing mechanism for supporting the shaft, a discharging device for discharging the transfer, and a joint mechanism which mechanically connects the discharging device with the transfer roller at both ends of the shaft. Both of the transfer roller and the discharging device can be integrally detached from and attached to the image forming apparatus without detaching/attaching the bearing mechanism, by use of a handle. Therefore, an operation for replacing the transfer roller and the discharging device can be performed easily.

22 Claims, 5 Drawing Sheets

IMAGE FORMING APPARATUS HAVING DETACHABLE TRANSFER ROLLER AND DISCHARGE DEVICE

BACKGROUND OF THE INVENTION

1. Field of the Invention

The present invention relates to an image forming apparatus having an image bearing member such as a photoconductor, a transfer roller which transfers an image on the image bearing member to a transfer member through a transfer nip between the image bearing member and the transfer roller, and a discharger which discharges the transfer member after the image has been transferred thereto.

2. Description of the Background Art

An image forming apparatus is known which has a transfer roller for transferring an image on an image bearing member to a transfer member through a transfer nip formed between the image bearing member and the transfer roller.

In such an image forming apparatus, as illustrated in FIG. 6, a drum-like photoconductor 51 as the image bearing member is rotated at a prescribed angular velocity in a direction indicated by an arrow C. An outer surface of the photoconductor 51 is charged uniformly to have a prescribed potential by a charger 52. Then, the charged surface is irradiated with light L by an exposure device (not shown) so that an electrostatic latent image is formed on the photoconductor 51.

The electrostatic latent image is developed with toner by a developer 54 so that a toner image is formed thereon. The toner image is carried with the rotation of the photoconductor 51 indicated by the arrow C, to a transferring region where a transfer roller 55 is disposed.

Further, a transfer sheet of paper (transfer member) P is fed by a sheet supplying member (not shown) at a prescribed timing. The toner image is transferred to the transfer sheet P using the transfer roller 55. Then, the transfer sheet P is fed out to a discharged sheet receiving tray etc., via a fixing device 56.

As shown in FIG. 7, the transfer roller 55, which is brought into contact with the outer surface of the photoconductor 51, generally includes a metal shaft 55*a* and a conductive elastic layer 55*b* made of conductive rubber or the like. The conductive elastic layer 55*b* is formed so that the metal shaft 55*a* except for both ends thereof is covered with the conductive elastic layer 55*b*. The both ends of the metal shaft 55*a* are left uncovered.

The metal shaft 55*a* is disposed so that the axis thereof is disposed parallel to that of the photoconductor 51. Both ends of the metal shaft 55*a* are rotatably supported by a plurality of bearings, respectively. The conductive elastic layer 55*b* is configured to be brought into contact with the outer surface of the photoconductor 51, imposing a prescribed pressure thereon. The transfer roller 55 is rotated at substantially the same circumferential speed as the photoconductor 51, and is biased by an electric source to have a bias potential opposite to that of the toner image on the photoconductor 51. Thereby, the transfer sheet P which is fed into the transfer nip is electrostatically charged so that the toner image is transferred from the photoconductor to the transfer sheet P.

As described above, the surface of the transfer roller 55 is generally made of a conductive elastic layer 55*b* which is compressed in the transfer nip where the conductive elastic layer 55*b* is brought into contact with the photoconductor 51 or the transfer sheet P. The compression of the compressed elastic conductive layer 55*b* in the transfer nip is released after the compressed portion has passed through the transfer nip. Because the compression and the release of compression of the conductive elastic layer 55*b* are repeated many times, the conductive elastic layer 55*b* is remarkably deteriorated by fatigue thereof. Therefore, a lifetime of the transfer roller 55 is generally shorter than that of the other components or the image forming apparatus.

Accordingly, replacement operations of a deteriorated transfer roller are generally required several times during the total lifetime of an image forming apparatus. In such an image forming apparatus, the transfer roller is configured so as to be attachable to and detachable from the main body of the image forming apparatus.

Because a transfer roller is a consumable component, many background image forming apparatuses are devised so that a transfer roller is easily detached from and attached to an image forming apparatus, in order to perform the replacement operation efficiently.

For example, an image forming apparatus disclosed in Japanese Laid-Open Patent Publication No. 6-3978 includes a transfer unit having a transfer roller and a supporting member for supporting the transfer roller. The transfer unit is configured to be detachable from and attachable to the image forming apparatus. The transfer unit may further include a pin-discharger for discharging a transfer member after an image has been transferred thereto. Thereby, the pin-discharger, as well as the transfer roller, can be replaced at once.

However, when the above-mentioned transfer unit is detached from the image forming apparatus, other components such as a plurality of bearings for rotatably supporting the transfer roller, a plurality of spring for pressing the plurality of bearings against the photoconductor, the pin-discharger if any, and so forth, are also taken out integrally, which may not need to be replaced. This is wasteful and contradicts the current trend toward reduction of wastes.

Further, as shown in FIG. 8, the transfer unit includes a transfer roller 65, a supporting member 63, a plurality of springs 67, a conductive bearing 61, a non-conductive bearing 62, and a plurality of stoppers 68. The combination of bearings 61 and 62 support the metal shaft 65*a* of the transfer roller 65. The combination of bearings 62 and 63 are each capable of being slid in a direction in which the plurality of springs 67 respectively press the combination of bearings 61 and 62. The plurality of stoppers 68 limit the movable range of the transfer roller 65, and thereby prevent the transfer roller 65 from falling off the combination of bearings 61 and 62.

Accordingly, in the process of taking out only the transfer roller 65 from the transfer unit, the plurality of stoppers 68 must be kept deformed by a force greater than a prescribed force, which is generally applied thereto using a jig or the like. Then, the transfer roller 65, as gripped by an operator's hand, can be drawn out from the transfer unit. Therefore, the job of taking out the transfer roller 65 is troublesome.

In addition, there may be a risk of dropping the transfer roller 65 during the process of taking it out, or injury caused by accident when the plurality of stoppers 68 are kept deformed using the jig.

Another background image forming apparatus is disclosed in Japanese Laid-Open Patent Publication No. 6-64279, which includes a cleaning tool having a handle. A brush is provided on one end of the handle, and a hooking portion that fits to a metal shaft of a transfer roller is provided on the other end. The transfer roller is configured to be easily taken out using the cleaning tool.

However, the cleaning member is not a necessary component for the transfer unit, although the hooking portion is provided for the operation of taking out the transfer member. Therefore, the problem is that the cost is increased by the cleaning member.

Further, in order to improve separation properties of the pin as an electrode for discharging the transfer member after an image has been transferred thereto, the end of the pin-discharger may be disposed close to the transfer nip, in which the transfer roller and the photoconductor are brought into contact with each other. In this case, however, the pin-discharger which is disposed close to the transfer roller is an obstacle in the operation of taking out the transfer roller.

SUMMARY OF THE INVENTION

Accordingly, the present invention has been made in view of the above-discussed and other problems, and an object of the present invention is to address the above-discussed and other problems.

Another object of the present invention is to provide a novel image forming apparatus including a transfer unit having a discharging device such as a pin-discharger which can be disposed in a position for achieving improved separation properties for separating a transfer sheet, wherein a job of exchanging a transfer roller can be performed with ease.

According to the present invention, an operation of replacing a deteriorated transfer roller can be performed without replacing the other elements which may not need to be replaced.

According to a preferred embodiment of the present invention, a novel image forming apparatus is provided, which includes an image bearing member, a transfer roller having a shaft, a discharging device, and at least one joint mechanism. The transfer roller transfers an image on the image bearing member to a transfer member through a transfer nip between the image bearing member and the transfer roller. The discharging device discharges the transfer member after the image has been transferred to the transfer member. The discharging device may be configured to be capable of being separated from the transfer roller by disconnecting the joint mechanism. The joint mechanism connects the discharging device with the shaft of the transfer roller. Further, the transfer roller and the discharging device are configured so that both of the transfer roller and the discharging device are capable of being integrally detached from and attached to the image forming apparatus. The joint mechanism may connect the discharging device with the transfer roller at both ends of the shaft.

The image forming apparatus may further include at least one bearing mechanism for rotatably bearing the shaft of the transfer roller.

The image forming apparatus may further include at least one handle for manually detaching from and attaching to the image forming apparatus.

The image forming apparatus may further include a supporting mechanism for supporting the discharging device. The supporting mechanism may support the discharging device so that the joint mechanism is disposed in an off-contact position with the shaft, during a period of time when the transfer roller is rotated.

Furthermore, the image forming apparatus may further include an electric contact through which a bias potential is provided to the discharging device. The electric contact may be disposed on the supporting mechanism.

According to another embodiment of the present invention, an image forming apparatus is provided, which includes an image bearing member, a transfer roller having a shaft for transferring an image on the image bearing member to a transfer member through a transfer nip between the image bearing member and the transfer roller, a discharging device for discharging the transfer member after the image has been transferred to the transfer member, and at least one supporting mechanism for supporting the discharging device with the shaft of the transfer roller.

The transfer roller and the discharging device are configured so that both of the transfer roller and the discharging device are capable of being integrally detached from and attached to the image forming apparatus. The transfer roller may be configured so as to be replaced at the same timing as the discharging device.

The image forming apparatus may further include at least one bearing mechanism for rotatably bearing the shaft and at least one elastic stopper for preventing the shaft of the transfer roller from falling off the bearing mechanism. In this image forming apparatus, the shaft is detached from the bearing mechanism when a force exceeding a holding force of the elastic stopper is applied to the shaft of the transfer roller. Further, an opening which is capable of being elastically deformed is formed in the supporting mechanism. The shaft of the transfer roller is capable of being engaged in the supporting mechanism through the opening. Also, the shaft is capable of being detached from the supporting mechanism through the opening when a force exceeding an engagement force of the opening is applied thereto. The engagement force is larger than the holding force with respect to a detaching direction of the transfer roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
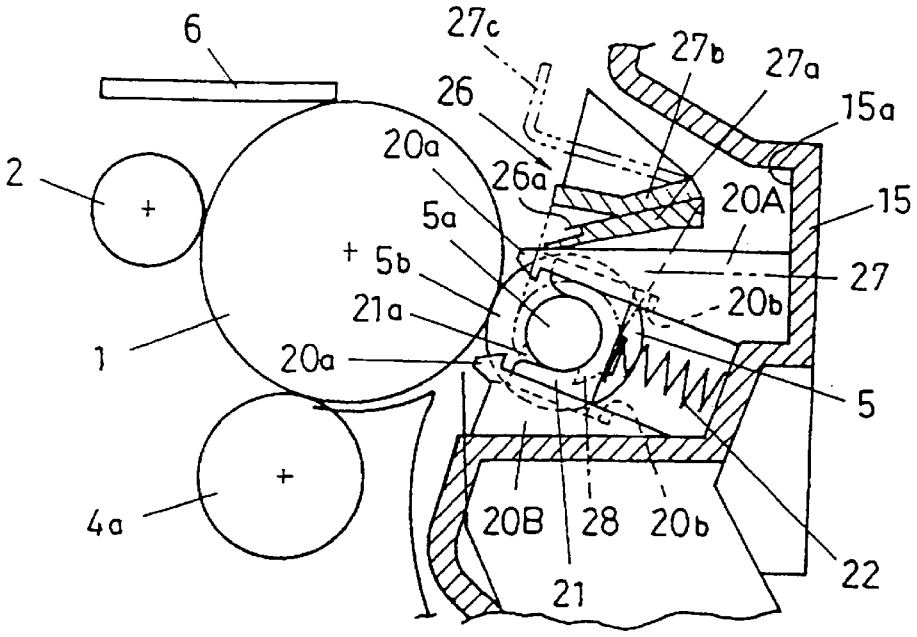
FIG. 1 illustrates a portion near a transfer roller of an image forming apparatus according to an embodiment of the present invention.

Referring now to the drawings, wherein like reference numerals designate identical or corresponding parts throughout the several views, preferred embodiments of the present invention are now explained.

An image forming apparatus according to an embodiment of the present invention is explained with reference to FIGS. 1–4.

Figure 4:
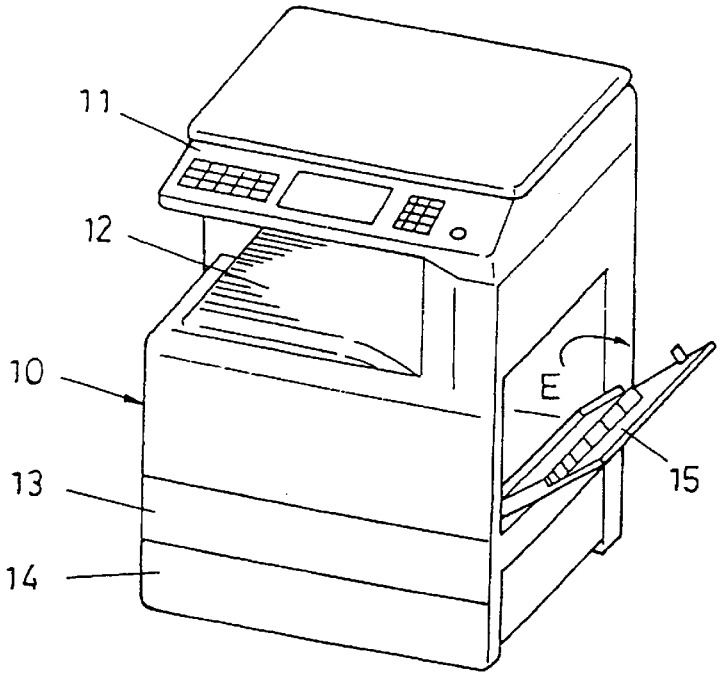
FIG. 4 is a drawing illustrating an external view of the image forming apparatus of FIG. 1.

As shown in FIG. 4, an operation panel 11, in which keys for performing various operations and the like are arranged, is provided in a front-upper portion of a main body 10 of the image forming apparatus. A discharged sheet receiving tray 12 is provided under the operation panel 11. Two sheet supplying cassettes 13 and 14 are provided below the discharged sheet receiving tray 12, each is capable of being pulled in a direction normal to the front side-surface of the image forming apparatus for supplying transfer sheets.

Further, in FIG. 4, a cover 15 which is capable of being opened and closed along a direction E is provided on the right side-surface of the main body 10. When a transfer sheet as a transfer member has been jammed near an image forming portion, the cover 15 is opened in order to remove the jammed sheet therefrom.

Figure 3:
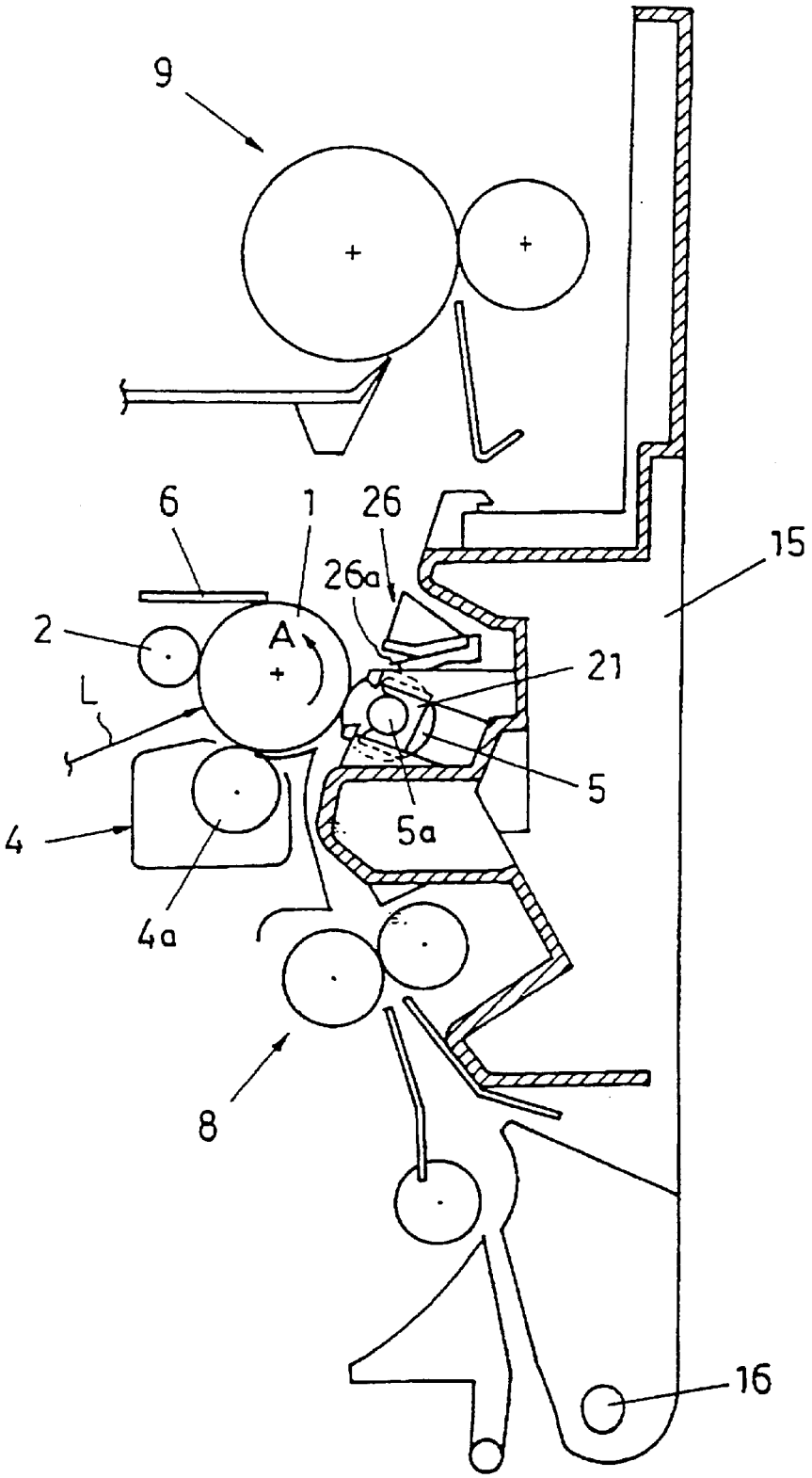
FIG. 3 is a view illustrating a portion near an image forming portion of the image forming apparatus of FIG. 1.

As shown in FIG. 3, the image forming apparatus includes a drum-like photoconductor 1 as an image bearing member. A photoconductive layer (not shown) is formed on the photoconductor 1. The photoconductor 1 is rotated in a direction indicated by an arrow A. Around the photoconductor 1 are provided a charging roller 2, an exposing device (not shown), and a developing device 4.

The charging roller 2 is brought into contact with the surface of the photoconductor 1, and is rotated in compliance with the rotation of the photoconductor 1. Further, the charging roller 2 is biased to have a voltage by a bias electric source, and charges the surface of the photoconductor 1 to have a uniform charge. The exposing device forms a latent electrostatic image by irradiating the photoconductor 1 with a laser beam L. The developing device 4 develops the latent image with toner to form a toner image.

The image forming apparatus further includes a transfer roller 5, which is disposed around the photoconductor 1 and is biased to have a voltage by a transfer bias source. The transfer roller 5 transfers the toner image formed by the developing device 4 to a transfer sheet as a transfer member. A cleaning blade 6 is also provided around the photoconductor 1. The cleaning blade 6 removes residual toner remaining on the photoconductor 1 after the toner image has been transferred to the transfer sheet.

When an image forming operation is started, the photoconductor 1 starts rotation thereof in a direction indicated by the arrow A of FIG. 3. Further, the surface of the photoconductor 1 is uniformly charged to have a prescribed potential by the charging roller 2, as mentioned above.

The charged surface is then irradiated with the laser beam L corresponding to the image to be formed. Therefore, an electrostatic latent image is formed on the photoconductor 1. When the electrostatic latent image, which is carried with the rotation of the photoconductor 1, reaches the developing device 4, the electrostatic latent image is developed with toner which is provided by a developer sleeve 4*a* biased by a developer bias electric source. Thereby a toner image (tangible image) is formed on the photoconductor 1.

The toner image thus formed on the photoconductor 1 is carried with the rotation of the photoconductor 1 indicated by the arrow A of FIG. 3 to the transfer nip at which the photoconductor 1 and the transfer roller 5 are brought into contact with each other.

A transfer sheet from one of the sheet supplying cassettes 13 and 14 of FIG. 4 is provided to a pair of registration rollers 8. The transfer sheet is carried by the pair of registration rollers 8 with a timing such that the front edge of the transfer sheet coincides with that of the toner image formed on the photoconductor 1. Further, the transfer sheet is introduced by a transfer inlet guide, and is further carried to the transfer nip at which the photoconductor 1 and the transfer roller 5 are brought into contact with each other.

In the transfer nip, the toner image on the photoconductor 1 is transferred to the transfer sheet by the transfer roller 5 which is biased to have a voltage applied thereto by a transfer bias source (not shown). The transfer sheet is discharged by a pin-discharger 26, which is further explained below. Then, the transfer sheet is guided by a carrier-guide and is carried to a fixing device 9. In the fixing device 9, the toner image of the transfer sheet is fused and fixed under heat and pressure applied thereto. The transfer sheet having the fixed toner image thereon is then output to the above-mentioned discharged sheet receiving tray 12.

The residual toner on the photoconductor 1 is scraped off by the cleaning blade 6. Then, the surface of the photoconductor 1 is discharged by a discharger lamp (not shown). The image forming process as described above is then repeated.

Next, the transfer roller 5 and the neighboring structure are explained hereinafter.

The transfer roller 5 is brought into contact with the photoconductor 1 to form the above-mentioned transfer nip. Therefore, the toner image on the photoconductor 1 is transferred to the transfer sheet (transfer member) through the transfer nip.

Figure 2:
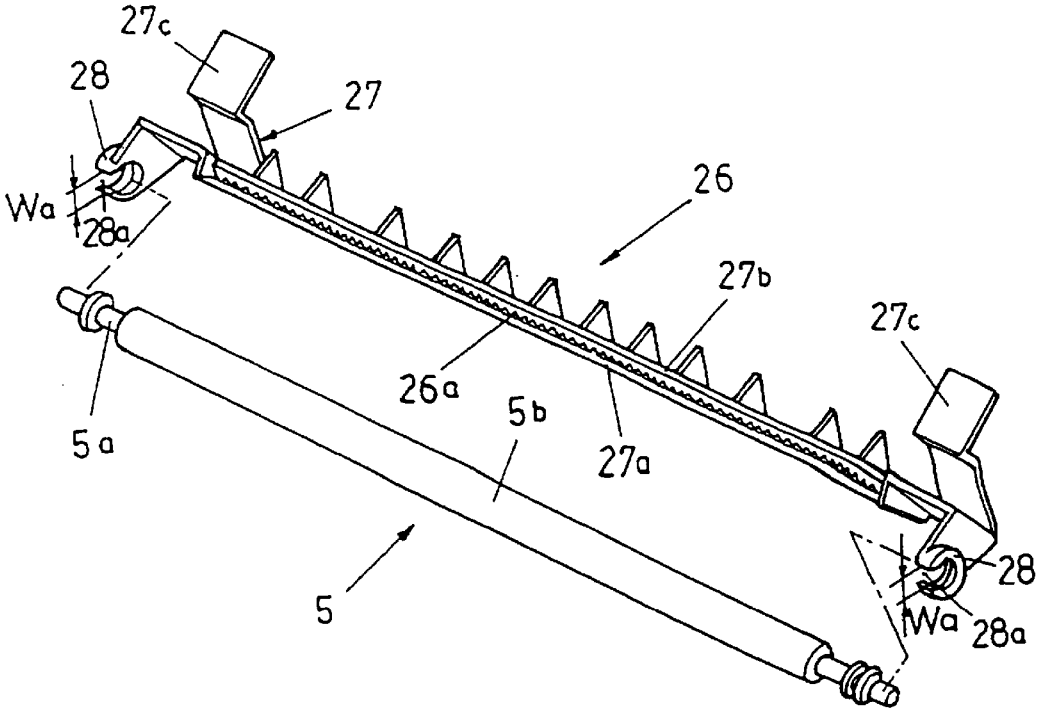
FIG. 2 is a view illustrating the transfer roller and a pin-discharger as a discharging member of the image forming apparatus of FIG. 1.

As shown in FIG. 2, the transfer roller 5 includes a metal shaft 5*a* which extends along the axis thereof and a conductive elastic layer 5*b* which covers the metal shaft 5*a*. However, both ends of the metal shaft 5*a* are uncovered by the conductive elastic layer 5*b*. The and properties of the transfer roller 5 are, for example, as follows: the outer diameter of the metal shaft 5*a* is 8 mm; the outer diameter of the conductive elastic layer 5*b* is 16 mm; the total length of the transfer roller 5 is 310 mm; and a hardness is 30 degrees measured by a spring-type hardness tester of C-type according to the Japanese Industrial Standard K6301 §5.2.

Further, an abutting roller (not shown) is disposed co-axially with the metal shaft 5*a* The abutting roller abuts on an end of the photoconductor 1 for limiting the movable range of the transfer roller 5. Therefore, the amount of encroachment of the photoconductor 1 into the conductive elastic layer 5*b* is limited.

In this embodiment, the amount of encroachment of the photoconductor 1 having a diameter of 30 mm is designed to be 0.1 mm, for example. In this case, the width of the transfer nip formed between the photoconductor 1 and the transfer roller 5 becomes about 2.5 mm.

The conductive elastic layer 5*b* is basically made of an elastic material such as rubber. Further, the resistance of the conductive elastic layer 5*b* can be adjusted by dispersing a conductive material such as carbon or metal oxide into the elastic material.

The resistance of such a conductive elastic material varies due to fluctuations in producing the conductive elastic material in which the conductive material is dispersed. Further, the resistance of the conductive elastic layer 5*b* varies due to environmental impacts imposed thereon. In this embodiment, the transfer roller 5 may be controlled with a constant current regulation method so that a constant current is supplied for the transfer roller 5. Therefore, the transfer operation can be stabilized against such variation of resistance of the conductive elastic layer 5*b*.

The transfer roller 5 is disposed on the inner side of the cover 15 which is set on the main body 10 illustrated in FIG. 4. In FIG. 3, a pivot 16 is provided in the cover 15 so that the cover 15 is capable of being opened and closed. Namely, the transfer roller 5 is in the main body 10 when the cover 15 is closed. The cover 15 is opened when the transfer roller 5 is needed to be replaced or a jammed sheet near the photoconductor 1 must be removed therefrom.

Next, a structure for supporting the transfer roller 5 is explained. As illustrated in FIG. 1, both ends of the metal shaft 5*a* of the transfer roller 5 are rotatably supported by a plurality of bearings 21 which have respective openings 21*a*. The plurality of bearings 21 are engaged in a plurality of grooves 20*b* of a plurality of bearing support-guides 20A and 20B, respectively. Each of the plurality of bearing support-guides 20A and 20B includes a stopper-nail 20*a*. A pair of stopper nails 20*a* operates as a stopper member for each end of the metal shaft 5*a* The plurality of bearing support-guides 20A and 20B are made of, for example, resin integrally formed with the cover 15.

Each of the bearings 21 is capable of being slid in both directions toward/apart from the photoconductor 1. Each pair of stopper-nails 20*a* limits the movable range of the metal shaft 5*a* so that the metal shaft 5*a* of the transfer roller 5 does not fall toward the photoconductor 1 even when the cover 15 is opened.

In addition, a plurality of springs 22, each made of conductive material, are provided between the cover 15 and the plurality of bearings 21, respectively. Each spring 22 presses each bearing 21 toward the photoconductor 1 with elastic force thereof. Therefore, a portion of the conductive elastic layer 5*b* of the transfer roller 5 is pressed against the surface of the photoconductor 1. Thus, the above-mentioned transfer nip is formed in the contacting portion.

At least one of the bearings 21 includes a conducting material. A transfer voltage is applied to the conductive bearing 21 through the spring 22. Thereby, the voltage can be applied to the transfer roller 5.

Because each bearing 21 is pressed by the spring 22 toward the photoconductor 1, the plurality of bearings 21 move toward the photoconductor 1 when the cover 15 is opened. However, as described above, the movement of each bearing 21 and the transfer roller 5 is limited, because the pairs of stopper-nails 20*a* are formed in the plurality of bearing guides 20A and 20B, respectively. Accordingly, the plurality of bearings 21 and the transfer roller 5 do not fall toward the photoconductor 1.

However, each pair of stopper-nails 20*a* can be deformed elastically such that a gap between the pair of stopper-nails 20*a* is extended when a force for extending the gap is applied thereto. In such a condition that the gap has been extended sufficiently, the transfer roller 5 can be easily taken out from the plurality of bearings 21 by pulling the transfer roller 5.

Downstream of the sheet carrying direction with respect to the transfer roller 5 (upper side of FIG. 1), the above-mentioned pin-discharger 26 as a discharging member for discharging the transfer sheet after the toner image has been transferred thereto is disposed in the main body 10 of the image forming apparatus. The pin-discharger 26 is supported by the metal shaft of the transfer roller 5 using a holder 27 as a supporting member. The holder is made of, for example, a kind of resin.

The pin-discharger 26 has a shape as illustrated in FIG. 2. Namely, with reference to FIGS. 1 and 2, a portion of serrate electrode plate 26*a* is sandwiched between a holder fore-plate 27*a* and a holder rear-plate 27*b* of the holder 27.

As illustrated in FIG. 1, the pin-discharger 26 is disposed in a concave portion 15*a* of the inside surface of the cover 15 so that the front edge of the serrate electrode plate 26*a* is directed toward the photoconductor 1. In this state, the pin-discharger 26 is configured not to obstruct movement of the transfer sheet passing through the transfer nip toward the fixing device 9.

Further, the front edge of the electrode plate 26*a* is configured not to spring out toward the photoconductor 1 from the upper ends of the holder front-plate 27*a* and the holder rear-plate 27*b*. Therefore, the electrode plate 26*a* is configured not to hurt a user or a maintenance engineer, who is attaching or detaching the transfer roller 5.

Furthermore, a voltage having a polarization opposite to that of the transfer roller 5 is applied to the pin-discharger 26 by an electric source provided in the main body 10. Thereby, the transfer sheet is discharged after the toner image has been transferred thereto. Alternatively, the pin-discharger 26 may be connected to the ground potential, without being biased with the voltage opposite to the transfer voltage.

In FIG. 2, a plurality of joints 28 are further provided in the image forming apparatus of the present invention, for connecting the holder 27 with the metal shaft 5*a* so that the pin-discharger 26 and the transfer roller 5 can be attached to and detached from the image forming apparatus. The plurality of joints 28 connect the holder 27 with both ends of metal shaft 5*a*.

A plurality of openings 28*a* are formed in the plurality of joints 28, respectively. The width Wa of the openings 28*a* can be varied according to elastic deformation of the resin thereof, as shown in FIG. 2. Both ends of the metal shaft 5*a* of the transfer roller 5 are respectively capable of being engaged in the plurality of joints 28, as shown in FIG. 1. Accordingly, the pin-discharger 26 can be supported by the metal shaft 5*a*.

Further, a pair of handles 27*c* which are used for taking out the transfer roller 5 can be formed on both ends of the holder 27.

The engagement force between the plurality of joints 28 and the metal shaft 5*a* is configured to be larger than that between the pairs of stopper-nails 20*a* and the metal shaft 5*a*, with respect to the direction of taking out the transfer roller 5.

In this image forming apparatus, when the transfer roller 5 is taken out for replacing an element, the cover 15 is opened. Then, the pair of handles 27*c* gripped by hand by, e.g., a maintenance engineer are manually drawn back by force for taking out the transfer roller 5. In this case, because both ends of the metal shaft 5*a* are respectively engaged in the plurality of joints 28, the force is also applied to the transfer roller 5 through the plurality of joints 28. Thereby, the force also draws back the transfer roller 5 so that the transfer roller 5 is also taken out from the cover 15.

Accordingly, with the movement of the transfer roller 5 in a direction of drawing back from the cover 15, both ends of the metal shaft 5*a* respectively abut on the pairs of stopper-nails 20*a* which are capable of being deformed elastically. Therefore, the drawing back-movement is once limited by the elastic force of the pairs of stopper-nails 20*a*.

Then, the force of drawing back is further strengthened. In this case, because the engagement force of the pairs of stopper-nails 20*a* which hold the metal shaft 5*a* in engagement with the plurality of bearings 21 is smaller than that of the plurality of joints 28 with the metal shaft with respect to the drawing back direction of the transfer roller 5, the respective gaps of the pairs of stopper-nails 20*a* are extended, while the plurality of joints 28 of the holder 27 are kept in engagement with the metal shaft 5*a* Therefore, both ends of the metal shaft 5*a* are respectively detached from the plurality of bearings 21, and come out from the pairs of stopper-nails 20*a*.

Therefore, the transfer roller 5, as well as the pin-discharger 26 and the holder 27, is taken out. Namely, the transfer roller 5 and the pin-discharger 26 are integrally taken out from the main body of the image forming apparatus.

Therefore, a lifetime of the transfer roller 5 can be designed to be the same as the pin-discharger 26. In this case, the operation of replacing these components can be performed at once with reduced work, in contrast to the case in which the two components are replaced with independent timing.

The job of taking out the transfer roller 5 can be simply achieved by drawing back the pair of handles 27*c* which are gripped by the hands of, e.g., a maintenance engineer, without touching the transfer roller 5 directly. Therefore, there is no risk of contaminating the transfer roller 5 due to direct contact with a hand, or varying resistance of the transfer roller 5 due to intense gripping of the transfer roller 5. Thereby, defects in the transferring operation can be prevented.

According to the image forming apparatus of the present invention, the job of exchanging the transfer roller 5 can be performed with ease without complicated procedure requesting careful attention thereto.

Alternatively, the lifetime of the transfer roller 5 may be designed to be different from that of the pin-discharger 26. In that case, because each opening 28*a* can be elastically deformed, the width of opening Wa is easily extended by a force which is applied thereto so that each end of the metal shaft 5*a* comes out from the opening 28*a*. Accordingly, the transfer roller 5 can be easily separated from the pin-discharger 26. Therefore, the transfer roller 5 or the pin-discharger 26 whose period of durability has expired can be replaced easily.

Figure 5:
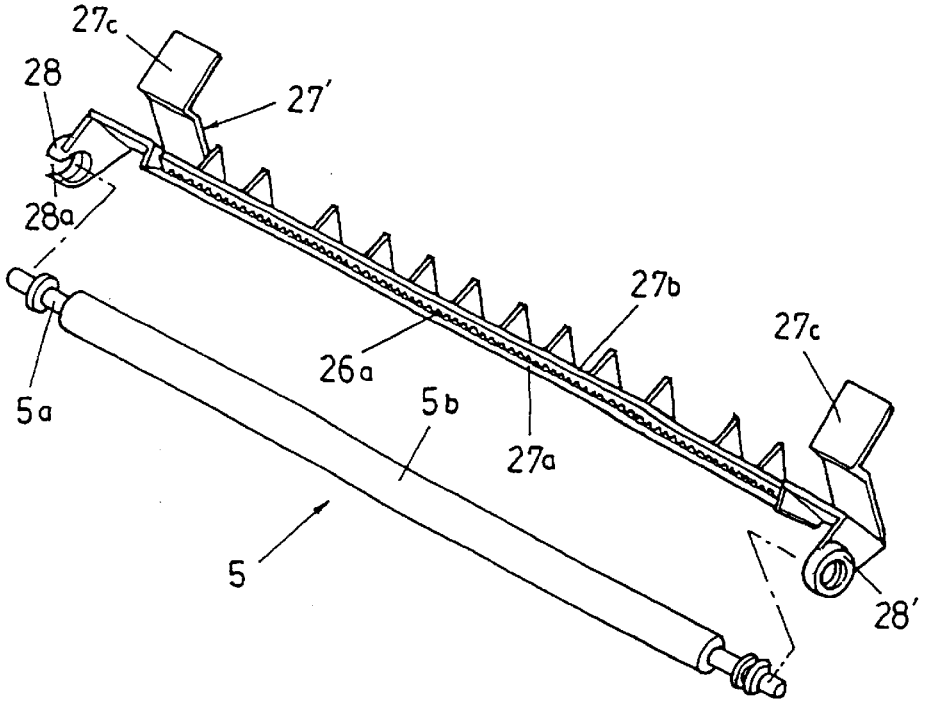
FIG. 5 is a view similar to FIG. 2, illustrating a transfer roller and a pin-discharger of another embodiment of the present invention.
Figure 6:
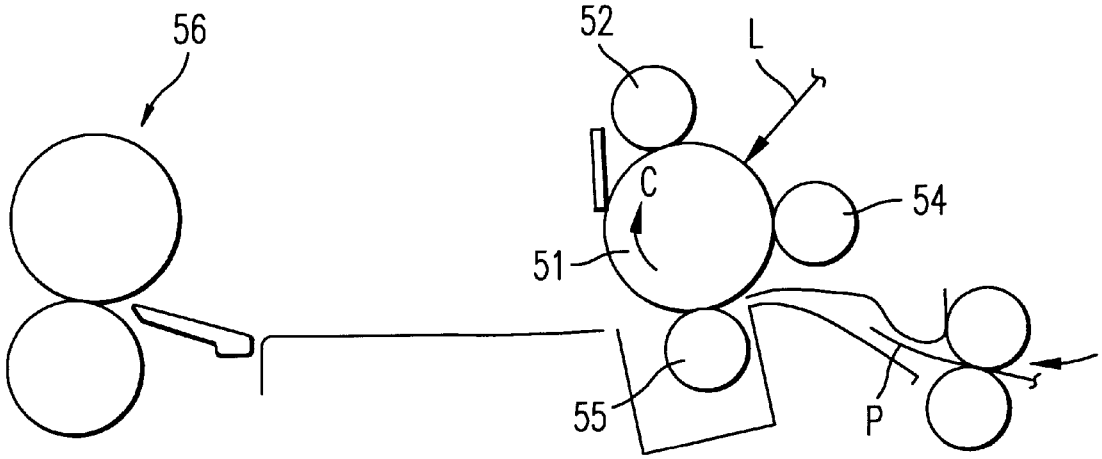
FIG. 6 (BACKGROUND ART)
FIG. 6 is a schematic view illustrating an image forming portion of a background image forming apparatus having a transfer roller.
Figure 7:
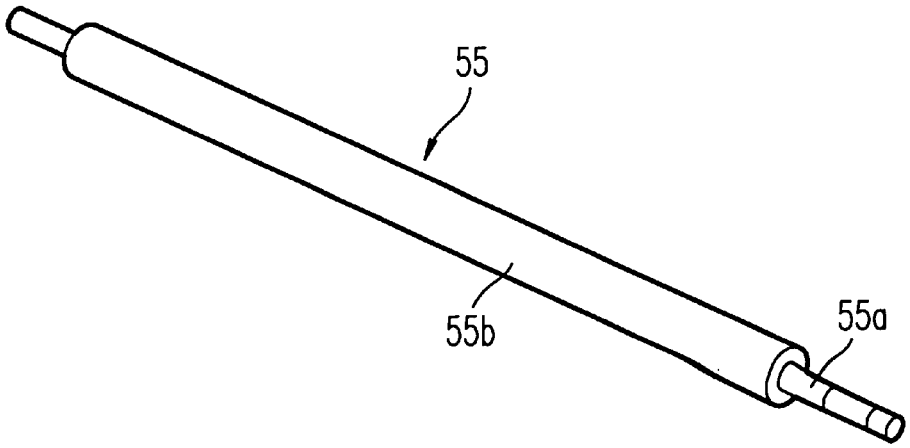
FIG. 7 (BACKGROUND ART)
FIG. 7 is a view illustrating the background transfer roller of FIG. 6.
Figure 8:
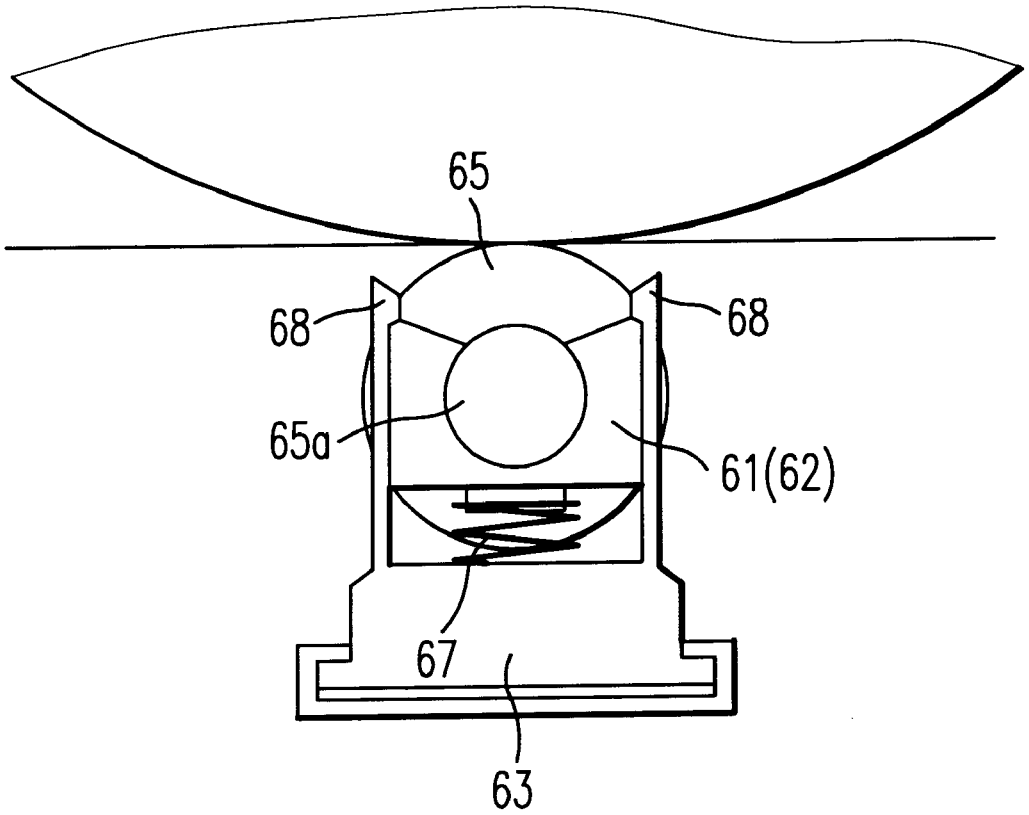
FIG. 8 (BACKGROUND ART)
FIG. 8 is a schematic view illustrating an exemplary background transfer unit.

As described above, when the lifetime of the transfer roller 5 is designed to be equal to that of the pin-discharger 26, the transfer roller 5 is not required to be separated from the pin-discharger 26. Therefore, a joint 28' having a circular hole may be formed in one end of a holder 27' as illustrated in FIG. 5. With this configuration, because the metal shaft 5*a* is surely prevented from dropping off the joint 28', the job of exchanging the comportment is further secured.

Generally, properties of a pin-discharger for separating a transfer sheet are improved when the front edge thereof approaches the transfer nip. However, in the above-mentioned background image forming apparatuses, when the front edge approaches the transfer nip portion too closely, the job of exchanging the component becomes difficult, because of obstacles due to the close existence of the pin-discharger.

According to the pin-discharger 26 as explained with reference to FIGS. 1–4, the pin-discharger 26 and the transfer roller 5 can be integrated using the holder 27 having the plurality of joints 28. Therefore, even when the pin-discharger 26 is disposed very close to the transfer nip, the pin-discharger 26 does not obstruct the job of exchanging a component of the transfer roller 5, and thereby the job can be done easily.

Further, an attachment as a supporting mechanism for supporting the pin-discharger may be provided in the image forming apparatus so that the pin-discharger is supported in a prescribed position in the image forming apparatus. In this case, the attachment may support the pin-discharger so that the metal shaft of the transfer roller can be rotated without friction between the plurality of joints and the metal shaft. For example, the plurality of joints may be disposed off-contact with the metal shaft, at least during a period of time when the transfer roller is rotated.

Furthermore, an electric contact may be provided for supplying a bias voltage for the pin-discharger. The electric contact may be disposed in the supporting mechanism.

In the above-described embodiments of the present invention, the transfer roller 5, which is brought into contact with the surface of the photoconductor 1 as an image bearing member and which transfers the toner image from the photoconductor 1 to the transfer sheet, is integrated with the pin-discharger 26 using the holder 27.

Further, according to the present invention, another image forming apparatus is also provided, which includes a transfer roller which is brought into contact with an intermediate transfer member, wherein a toner image is directly transferred from a photoconductor to the intermediate transfer member, and is further transferred to a transfer sheet. In this embodiment, the transfer roller is integrated with a pin-discharger for discharging the transfer sheet which has passed through the transfer nip between the transfer roller and the intermediate transfer member. The holder 27 as explained with reference to FIG. 2 or 5 may be employed.

Obviously, numerous additional modifications and variations of the embodiments disclosed herein are possible in light of the above teachings. It is therefore to be understood that within the scope the appended claims, the present invention may be practiced otherwise than as specifically described herein.

This document is based on Japanese Patent Application No. 10-290771, filed in the Japanese Patent Office on Oct. 13, 1998, the entire contents of which are hereby incorporated herein by reference.

What is claimed is:

1. An image forming apparatus comprising:

an image bearing member;

a transfer roller having a shaft, and configured to transfer an image on the image bearing member to a transfer member through a transfer nip between the image bearing member and the transfer roller;

at least one bearing mechanism for rotatably bearing the shaft of the transfer roller;

a discharging device configured to discharge the transfer member after the image has been transferred to the transfer member; and at least one joint mechanism configured to connect the discharging device with the shaft of the transfer roller, wherein the transfer roller and the discharging device are configured so that both of the transfer roller and the discharging device can be integrally detached from and attached to the image forming apparatus without detaching or attaching the at least one bearing mechanism from the image forming apparatus.

2. An image forming apparatus according to claim 1, further comprising at least one handle for manually detaching from and attaching to the image forming apparatus.

3. An image forming apparatus according to claim 1, further comprising a supporting mechanism configured to support the discharging device.

4. An image forming apparatus according to claim 3, wherein the supporting mechanism supports the discharging device so that the at least one joint mechanism is disposed in an off-contact position with the shaft, during a period of time when the transfer roller is rotated.

5. The image forming apparatus according to claim 3, further comprising an electric contact through which a bias potential is provided to the discharging device, wherein the electric contact is disposed on the supporting mechanism.

6. The image forming apparatus according to claim 1, wherein the at least one joint mechanism connects the discharging device with the transfer roller at opposite ends of the shaft.

7. The image forming apparatus according to claim 1, wherein the discharging device is further configured to be separated from the transfer roller by disconnecting the at least one joint mechanism.

8. The image forming apparatus according to claim 1, wherein the at least one joint mechanism supports the discharging device.

9. The image forming apparatus according to claim 1, wherein the transfer roller is further configured to be replaced at a same timing as the discharging device.

10. An image forming apparatus comprising:

an image bearing member;

a transfer roller having a shaft, and configured to transfer an image on the image bearing member to a transfer member through a transfer nip between the image bearing member and the transfer roller;

at last one bearing mechanism for rotatably bearing shaft one of the transfer roller;

a discharging device configured to discharge the transfer member after the image has been transferred to the transfer member; and at least one supporting mechanism configured to support the discharging device with the shaft of the transfer roller, wherein the transfer roller and the discharging device are configured so that both of the transfer roller and the discharging device can be integrally detached from and attached to the image forming apparatus without detaching or attaching the at least one bearing mechanism from the image forming apparatus.

11. An image forming apparatus according to claim 10, wherein the transfer roller is configured to be replaced at a same timing as the discharging device.

12. An image forming apparatus comprising:

an image bearing member;

a transfer roller having a shaft, and configured to transfer an image on the image bearing a member to a transfer member through a transfer nip between the image bearing member and the transfer roller;

a discharging device configured to discharge the transfer member after the image has been transferred to the transfer member;

at least one bearing mechanism configured to support the discharging device with the shaft of the transfer roller;

at least one bearing mechanism configured to rotatably bear the shaft; and at least one elastic stopper configured to prevent the shaft from falling off the bearing mechanism, wherein the shaft is detached from the bearing mechanism when a force exceeding a holding force of the elastic stopper is applied to the shaft of the transfer roller, and wherein an opening which is configured to be elastically deformed is formed in the supporting mechanism, through which the shaft of the transfer roller can be engaged in the supporting mechanism and through which the shaft can be detached from the supporting mechanism when a force exceeding an engagement force of the opening is applied thereto, and wherein the engagement force is larger than the holding force with respect to a detaching direction of the transfer roller;

wherein the transfer roller and the discharging device are configured so that both of the transfer roller and the discharging device can be integrally detached from and attached to the image forming apparatus.

13. An image forming apparatus including an image bearing member, a transfer roller having a shaft, and for transferring an image on the image bearing member to a transfer member through a transfer nip between the image bearing member and the transfer roller, and at least one bearing mechanism for rotatably bearing the shaft of the transfer roller;

and a discharging device for discharging the transfer member after the image has been transferred thereto, the image forming apparatus comprising:

means for connecting the shaft with the discharging device;

wherein the transfer roller and the discharging device are configured so that both of the transfer roller and the discharging device can be integrally detached from and attached to the image forming apparatus without detaching or attaching the at least one bearing mechanism from the image forming apparatus.

14. An image forming apparatus according to claim 13, further comprising means for supporting the discharging device.

15. An image forming apparatus comprising:

an image bearing member;

a transfer roller having a shaft, and configured to transfer an image on the image bearing member to a transfer member through a transfer nip between the image bearing member and the transfer roller;

a discharging device configured to discharge the transfer member after the image has been transferred to the transfer member;

at least one joint mechanism configured to connect the discharging device with the shaft of the transfer roller; and at least one handle for manually detaching from and attaching to the image forming apparatus;

wherein the transfer roller and the discharging device are configured so that both of the transfer roller and the discharging device can be integrally detached from and attached to the image forming apparatus.

16. An image forming apparatus according to claim 15, further comprising a supporting mechanism configured to support the discharging device.

17. An image forming apparatus according to claim 16, wherein the supporting mechanism supports the discharging device so that the at least one joint mechanism is disposed in an off-contact position with the shaft, during a period of time when the transfer roller is rotated.

18. The image forming apparatus according to claim 16, further comprising an electric contact through which a bias potential is provided to the discharging device, wherein the electric contact is disposed on the supporting mechanism.

19. The image forming apparatus according to claim 15, wherein the at least one joint mechanism connects the discharging device with the transfer roller at opposite ends of the shaft.

20. The image forming apparatus according to claim 15, wherein the discharging device is further configured to be separated from the transfer roller by disconnecting the at least one joint mechanism.

21. The image forming apparatus according to claim 15, wherein the at least one joint mechanism supports the discharging device.

22. The image forming apparatus according to claim 15, wherein the transfer roller is further configured to be replaced at a same timing as the discharging device.

* * * * *